US010364563B1

(12) United States Patent
Florence

(10) Patent No.: US 10,364,563 B1
(45) Date of Patent: Jul. 30, 2019

(54) RUNOFF WATER MANAGEMENT SYSTEM

(71) Applicant: Thomas Florence, West Dennis, MA (US)

(72) Inventor: Thomas Florence, West Dennis, MA (US)

( * ) Notice: Subject to any disclaimer, the term of this patent is extended or adjusted under 35 U.S.C. 154(b) by 0 days.

(21) Appl. No.: 15/863,882

(22) Filed: Jan. 6, 2018

Related U.S. Application Data

(60) Provisional application No. 62/443,335, filed on Jan. 6, 2017.

(51) Int. Cl.
*E03F 1/00* (2006.01)

(52) U.S. Cl.
CPC ..... *E03F 1/002* (2013.01)

(58) Field of Classification Search
CPC ..... E03F 1/002; E03F 5/041; E02B 11/00
USPC ..... 405/43, 48, 49
See application file for complete search history.

(56) References Cited

U.S. PATENT DOCUMENTS 1,079,262 A * 11/1913 Petersen ..... E03F 1/003 210/315
1,759,330 A * 5/1930 Horne ..... E02B 11/005 138/103
4,982,533 A 1/1991 Florence
4,983,069 A 1/1991 Florence
5,086,594 A 2/1992 Florence
5,131,196 A 7/1992 Florence
5,195,284 A 3/1993 Florence
5,249,885 A 10/1993 Florence
D350,814 S 9/1994 Florence
D350,815 S 9/1994 Florence
D350,816 S 9/1994 Florence
D576,714 S 9/2008 Florence
2006/0182497 A1* 8/2006 Potts ..... E03F 1/002 405/46
2007/0077122 A1* 4/2007 Birchler ..... E03F 1/003 405/46

FOREIGN PATENT DOCUMENTS

DE 19834857 * 7/2002

* cited by examiner

*Primary Examiner* — Sean D Andrish
(74) *Attorney, Agent, or Firm* — John P. McGonagle

(57) ABSTRACT

A hollow drywell apparatus adapted to being positioned beneath the ground and to receive surface water for discharge over a subsurface area in the ground is provided. The drywell has a top with a large diameter top port, a side wall with a plurality of smaller diameter drain-type ports generally uniformly distributed about the drywell side wall surface, and an open bottom. The top port receives a collector assembly acting as a surface drain. Optional larger diameter inlet ports may be formed in the sidewall to provide interconnection between and ganging of adjacent drywells. A diverter is positioned over each drain-type port along either the drywell wall surface exterior, or optionally the wall surface interior. Each diverter laterally dispenses water from the drywell interior while blocking back fill from entering the drywell assembly interior.

4 Claims, 7 Drawing Sheets

RUNOFF WATER MANAGEMENT SYSTEM

CROSS-REFERENCE TO RELATED APPLICATIONS

Applicant claims the priority benefits of U.S. Provisional Patent Application No. 62/443,335, filed Jan. 6, 2017.

BACKGROUND OF THE INVENTION

This invention relates to water management, and in particular, to an apparatus for collecting and diverting runoff surface water or waste water and controlling the flow and direction of subsurface water.

The control and flow of surface water, such as rain water, is important in preventing damage to foundations and basement flooding as well as damage to other structures. Unmanaged surface water also causes soil erosion, plant damage and is the primary cause of non-point source pollution damaging 80% of all water resources. Equally important is the ability to conserve surface runoff as well as waste water for reuse.

Soil composition is an important consideration in planning a drainage system. There are three basic types of soil, i.e., sand, silt and clay. Each of these soils have different drainage and retention capacity. Sand granules are larger and more porous which provide good drainage. Silt granules are smaller and more densely packed which slows the drainage process. Clay granules are smooth and tightly packed which tends to retain water.

It is not uncommon to encounter blends of the basic soil types along with various granules of crushed and larger stone gravel. The effects of soil types in an area selected for sub-surface leaching (absorption) are as follows. Sandy, gravely soil is best and will drain away runoff water quickly. Silty soil will absorb water in time. Clay soil can restrict absorption and retain water within the excavation for an extended period of time. Soil composition, therefore, is a controlling factor in the leaching process, i.e., dispersion of unwanted surface water underground.

To install an effective leaching system, there are other factors to consider, in addition to soil composition. An estimate of the volume of water entering the drainage system and the size of a reservoir established to receive the water. A leaching reservoir temporarily holds water allowing time for it to disperse into the surrounding soil. The size of the reservoir required is determined by the surrounding soil. Sandy soil requires a smaller reservoir as the water is dispersed quickly. Clay soil requires a larger reservoir to provide more time for absorption and evaporation.

Generally, leaching reservoirs are drywells employed to receive therein surface water and to permit the discharge of the surface water beneath the ground and away from the foundation, wall or structure and over a defined area. The basic purpose is to prevent flooding, erosion, washout and plant damage to residential landscapes, industrial properties, recreational, e.g., golf courses, properties and farms.

In the past surface water was commonly trenched or piped to a hole in the ground filled with stone, known as a drywell. Typically a drywell would comprise an open pit or a container optionally filled with loose aggregate material, such as gravel or loose stones, into which the surface water is directed either by a grate on the top surface wherein the top surface of the drywell is generally flush or slightly below the ground level or from a pipe which may be connected to the source of surface water, such as rain water from a downspout, and which permits the discharge of the water into the drywell. However, in time voids in the aggregate material fill with silt and debris and the drywell becomes ineffective.

Other prior art drywells have been built with bricks or masonry blocks. The masonry structures were built with open spaces between the sidewall blocks allowing water to seep out into the surrounding soil. These drywells were typically surrounded with stones to prevent backfill soil from entering the sidewall spaces and thus clogging the masonry drywell. However, the voids in the surrounding stone would often become plugged with soil thus limiting or preventing outflow. Another limitation of the use of stone is the cost and labor intensity of larger excavations to accommodate the stone, plus the added cost of hauling and installing stone to prevent intruding backfill soil.

An alternative to surrounding a reservoir with stone is to wrap the exterior drywell sidewall with geotechnical fabric. It was anticipated that such fabric would be long lasting and provide the obvious cost saving benefits when compared to installing stone. Aside from the potential difficulties related to fabric displacement during the backfilling process leaving the drywell sidewall ports exposed, over time geotechnical fabrics deteriorate triggering complete failure of the system. Another major concern with the use of geotechnical fabric is that silt and debris from runoff water often clog the inner side of the fabric. Leaves, twigs and silt collected in eve troughs or traveling along the ground in storm water commonly enter a drywell. Once inside a reservoir wrapped with geotechnical fabric debris becomes trapped against the fabric covering outflow ports impeding the leaching process.

Applicant has previously developed simplified water management solutions with modularized drywells that may be installed in various terrains in limited or open spaces. See U.S. Design Pat. Nos. D576,714; D350,816; D350,815; D350,814; and U.S. Pat. Nos. 5,249,885; 5,195,284; 5,131,196; 5,086,594; 4,983,069; and 4,982,533, all incorporated by reference. Applicant's previously developed drywell units offered a variety of lightweight, low impact installations to mitigate wet basements as well as damage to landscape features. Applicant's basic drywell unit is a single 50 gallon reservoir for small drainage projects. The basic unit is designed with the capability to stack or interconnect with additional units to accommodate larger volumes of water.

Utilizing data resulting from past installations, applicant has continued his efforts to improve the efficacy of the modular design concept. Given that soil conditions are a controlling element in designing water management solutions, it is apparent that reservoir capacity and outflow are the primary mitigating components in subsurface leaching systems.

It had become apparent to applicant, that a single reservoir may be only sufficient for small volumes in good leaching soil. To increase leaching capacity in the prior art, sidewall leaching was added as the reservoir filled due to soil saturation at the drywell bottom. Sidewall leaching is beneficial, however absorption into the surrounding soil is limited. As water exits through drywell sidewall ports, the exiting water tends to flow downward following the reservoir wall. As a result, the majority of the leaching plume is at the base of the reservoir.

SUMMARY OF THE INVENTION

To overcome the limitations of the prior art, the present invention adds sidewall diverters to applicant's prior art drywells. The sidewall diverters dispense water away from the sidewall ports into the surrounding soil starting from the top of the drywell reservoir. The process of controlling the flow and direction of subsurface water starting at the top of the sidewall increases the size of the overall plume. Along with the increased lateral distribution there is a reduction of soil saturation at the base of the reservoir. The combined benefits create a uniform leaching process capable of handling increased inflow volume and providing expeditious plume evaporation. The sidewall diverters also serve to prevent backfill soil from intruding into the reservoir interior as well as deflecting water outward. The diverters eliminate the need for surrounding stone, thereby reducing up to 70% of the cost of a typical drywell installation of equal proportions. Drywell reservoirs can be of various sizes and configurations. The diverters are the key to operation of the present invention.

The present invention comprises a preferably molded plastic, hollow drywall adapted to being positioned beneath the ground and to receive surface water for discharge over a subsurface area in the ground. The drywell has a top with a large diameter top port, a side wall with a plurality of smaller diameter drain-type ports generally uniformly distributed about the drywell side wall surface, and an open bottom. Optional larger diameter inlet ports may be formed in the sidewall to provide interconnection between and ganging of adjacent drywells. A diverter is positioned over each drain-type port along either the drywell wall surface exterior, or optionally the wall surface interior. The diverters effectively increase the water handling capacity of a drywell of a given size.

These together with other objects of the invention, along with various features of novelty which characterize the invention, are pointed out with particularity in this disclosure and the attached claims. For a better understanding of the invention, its operating advantages and the specific objects attained by its uses, reference should be made to the accompanying drawings and descriptive matter in which there is illustrated a preferred embodiment of the invention.

DETAILED DESCRIPTION OF THE INVENTION

Figure 1:
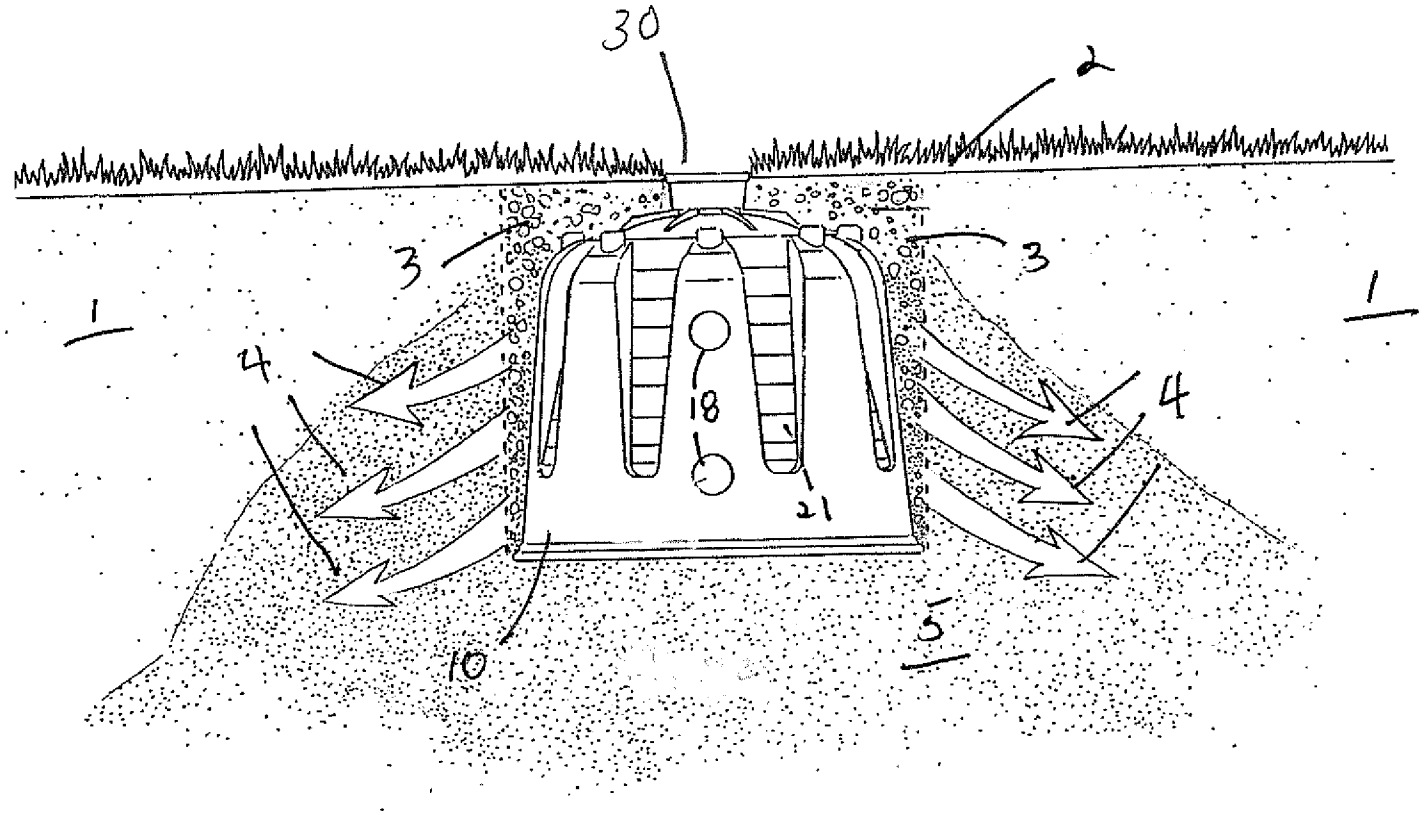
FIG. 1 is a side view of the invention drywell installed in the ground.
Figure 3:
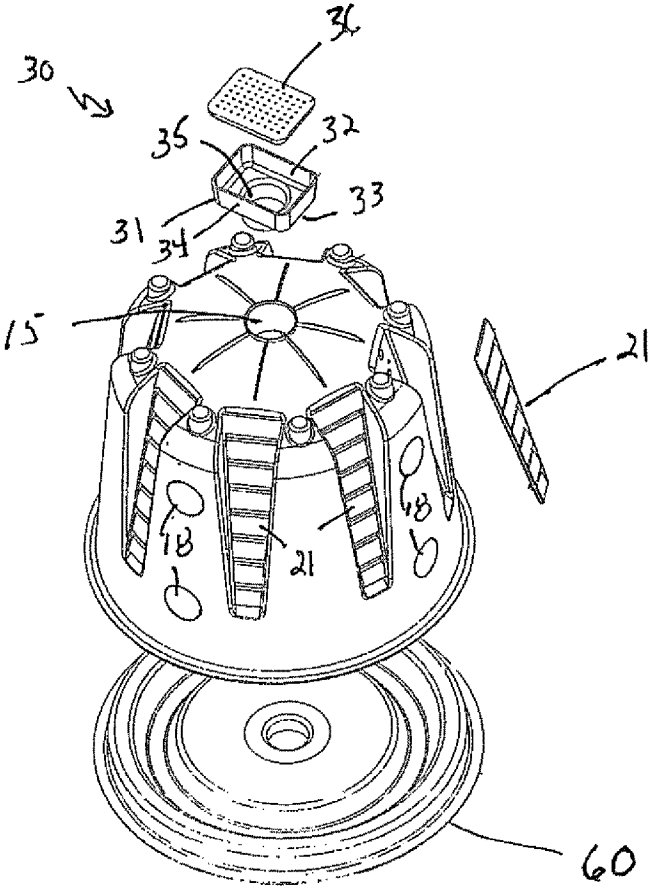
FIG. 3 is a top perspective, exploded view of the invention drywell.
Figure 2:
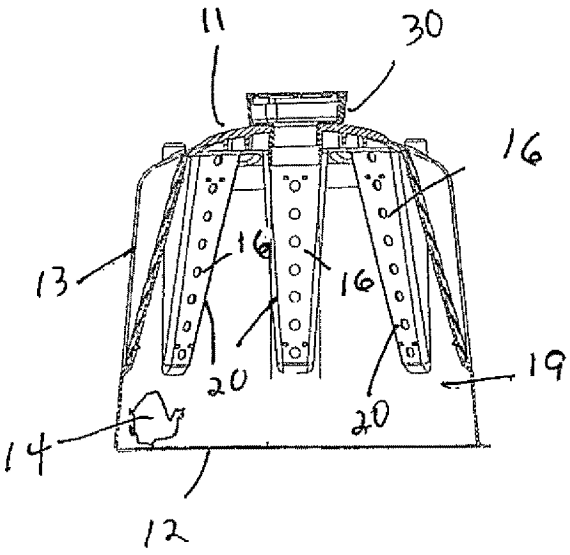
FIG. 2 is a side elevational view of the invention drywell without diverters.
Figure 7:
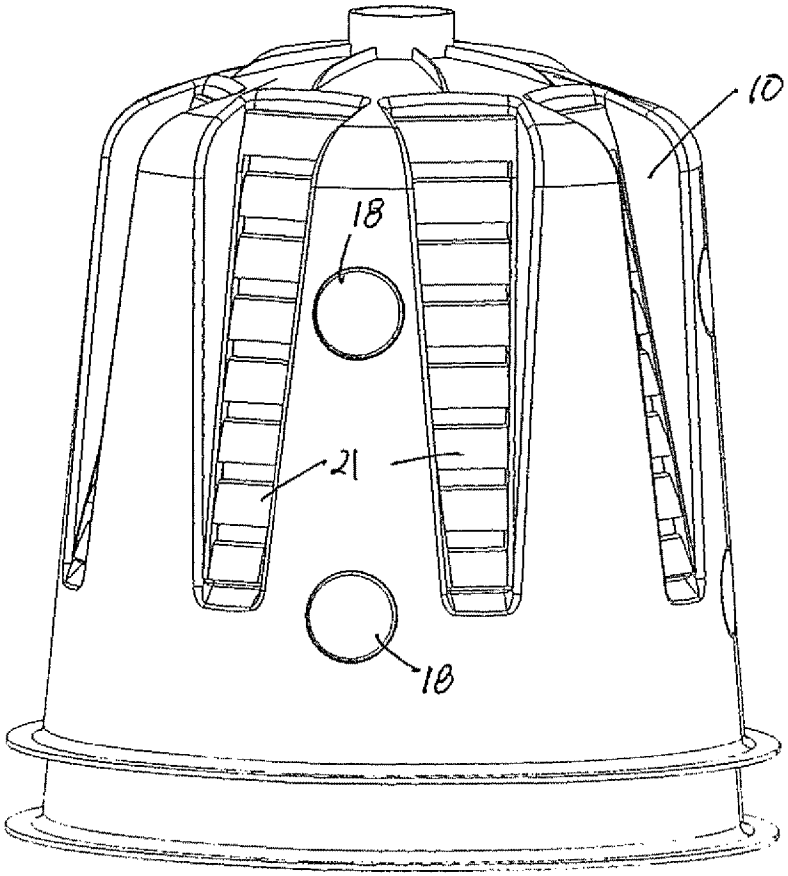
FIG. 7 is a side elevational view of two invention drywells in a stacked configuration for transportation or storage.
Figure 4:
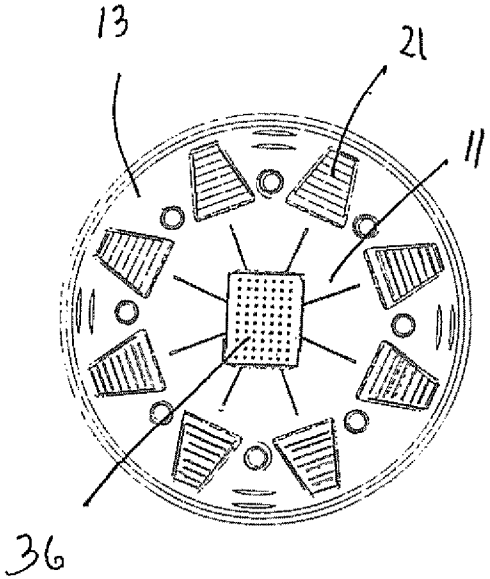
FIG. 4 is a top view of the invention drywell.
Figure 5:
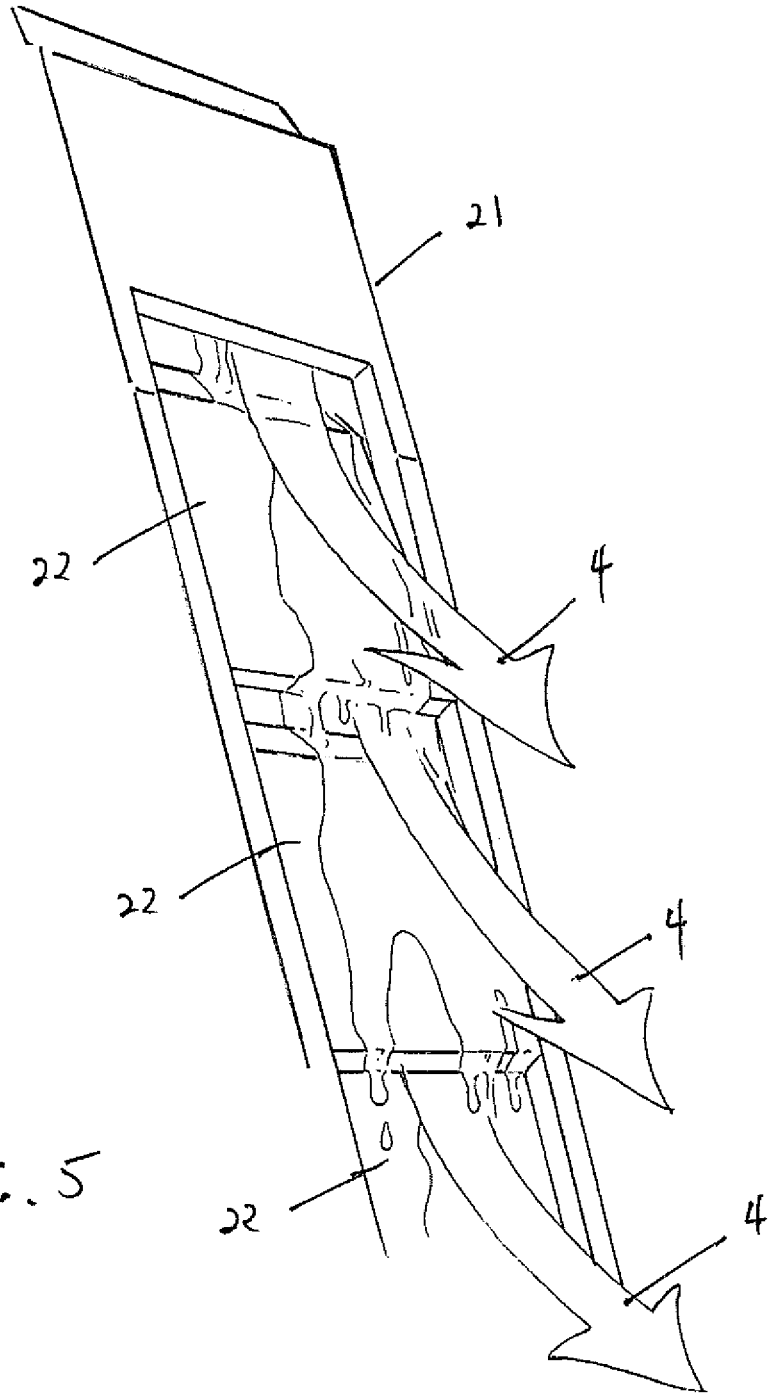
FIG. 5 is a schematic, illustrative, sectional view of an invention diverter.
Figure 6:
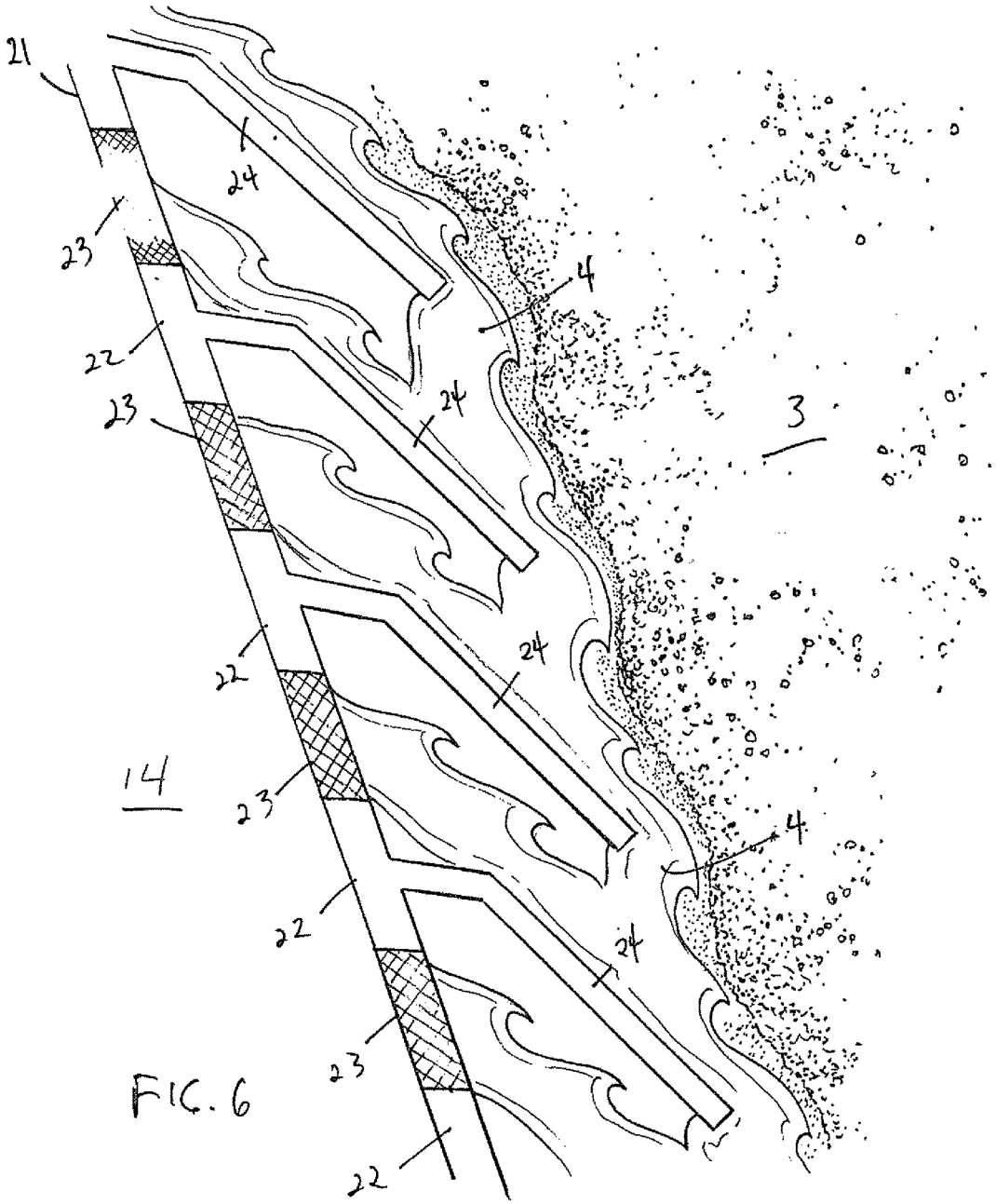
FIG. 6 is a schematic, illustrative, cross-sectional view of an invention diverter.

Referring to the drawings in detail and in particularly FIGS. 1-7 wherein like elements are indicated by like numerals, there is shown a drywell 10 constructed according to the principles of the present invention. The drywall 10 may have various shapes, but in this embodiment has a generally cylindrical or bell-like shape, with a top 11, an open bottom 12, and a sidewall 13 interconnecting the drywell top and bottom. The drywell top, bottom and sidewall define a drywell interior 14. The drywell top 11 has a large diameter, central, top port 15, opening into the drywell interior. The top port 15 is adapted to receive a collector assembly 30, acting as a surface drain. Optionally, the top port 15 may be connected to a pipe feeding surface water from another source. The drywell sidewall 13 has a plurality of smaller diameter drain-type ports 16 generally uniformly distributed about the cylindrical wall surface. The drywell bottom 12 is open. A removable base cover 60 may be provided. The base cover is used for stacking drywells 10 before installation. The drywell sidewall 13 may also have a plurality of larger diameter inlet/outlet ports 18 formed therein to provide interconnection between and ganging of adjacent drywells.

In one embodiment of the invention, a plurality of vertical channels 20 are formed on the sidewall exterior 19. The sidewall drain-type ports 16 are arranged to open from the drywell interior 14, out through the channels 20. A diverter strip 21 is fixedly seated in each channel 20. Each diverter strip 21 is comprised of a plurality of diverters 22 corresponding to the drain-type ports 16 opening into each channel 20. Each diverter 22 has an opening 23 corresponding to a drain-type port 16 and an overhang flange 24 above the opening 23 and downwardly bent. In alternate embodiments, an individual diverter 22 may be positioned over each drain-type port 16 along the cylindrical wall surface exterior 19. The overhead flange 24 prevents backfill soil from intruding into drywell interior 14. The diverter 22 also provides means for the water within the drywell interior 14 to laterally disperse into the surrounding soil, beginning at the top of the drywell. This increases lateral distribution and increases the size of the overall plume.

Figure 9:
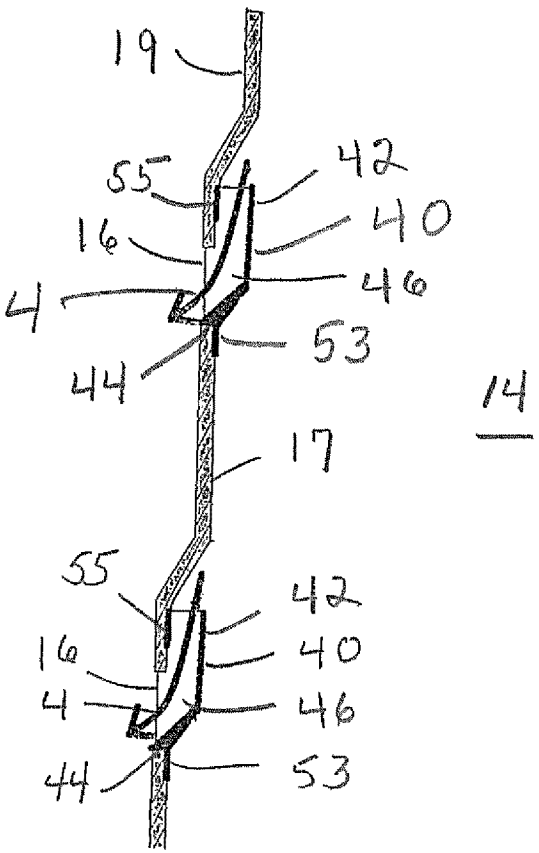
FIG. 9 is a cross section view of a drywell sidewall with interior diverters installed.
Figure 8:
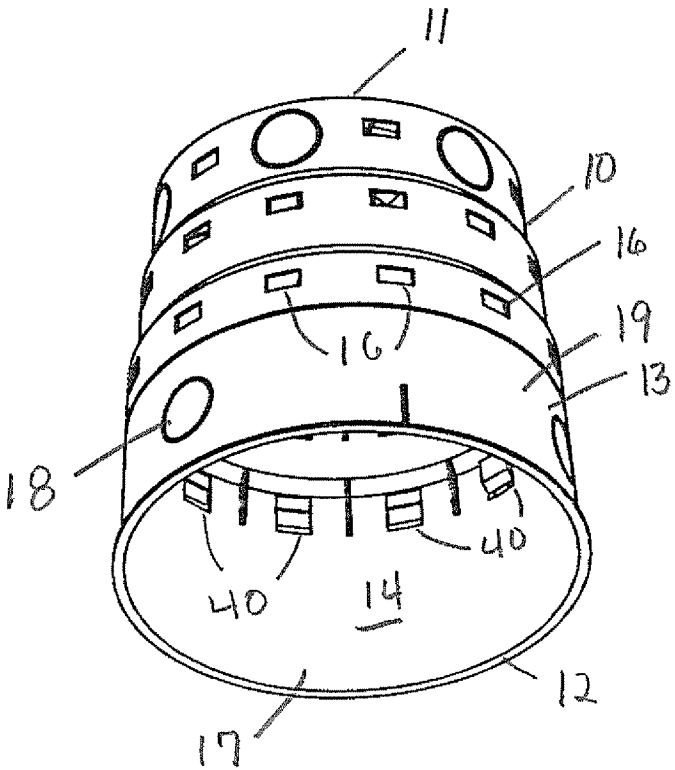
FIG. 8 is a bottom perspective view of the invention drywell with interior diverters.
Figure 12:
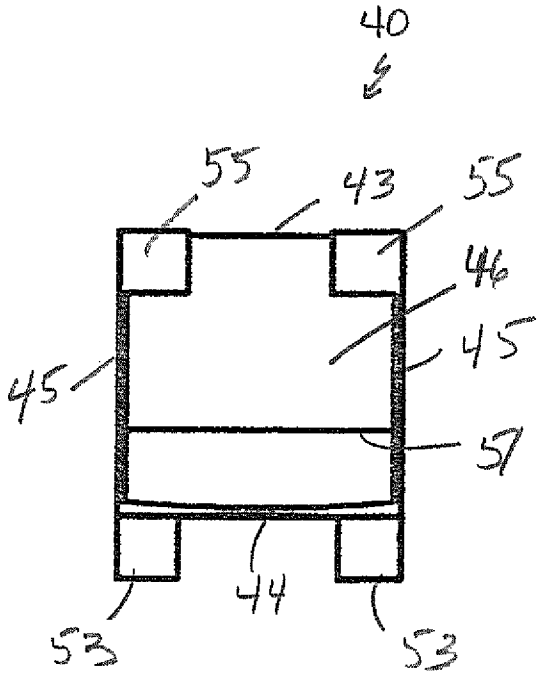
FIG. 12 is a front view of an interior diverter.
Figure 11:
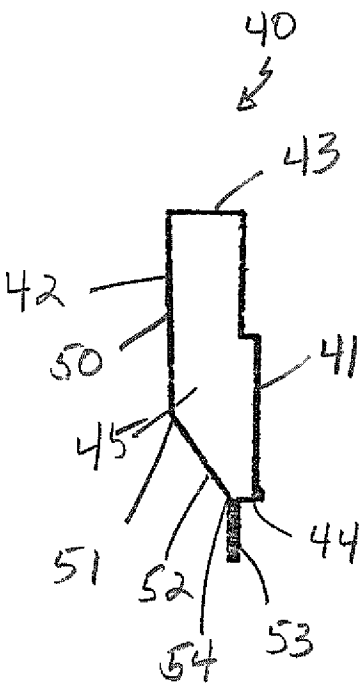
FIG. 11 is a side view of an interior diverter.
Figure 10:
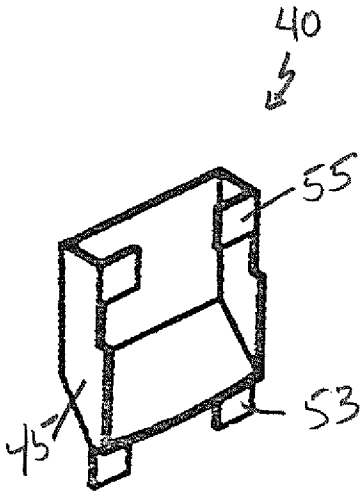
FIG. 10 is a perspective view of an interior diverter.

Referring more particularly to FIGS. 8-12, in another embodiment of the invention, an interior diverter 40 is attached to the sidewall interior 17, within the drywell interior 14, about each drain port 16. The drain ports 16 each have a generally rectangular shape. Each interior diverter 40 has a front 41, rear 42, open top 43, bottom 44, and two opposite, identical sides 45. The interior diverter front, rear, top, bottom and sides define a hollow interior diverter interior 46.

The interior diverter rear 42 is divided into two sections, a top section and a lower section. The interior diverter rear top section 50 is flat and extends vertically downward to a horizontal line 51. The interior diverter rear lower section 52 extends downward from the horizontal line 51 and forward to the beginning of the interior diverter bottom 44. One or more downwardly extending flanges 53 are formed at the junction 54 of the interior diverter rear lower section 52 and the interior diverter bottom 44. The interior diverter front 41 has two holding tabs 55 adjacent the interior diverter top 43 and extending from the interior diverter sides 45 toward each other. The remainder of the interior diverter front 41 is open.

An interior diverter 40 is positioned about a drain port 16 wherein the interior diverter front 41 engages the drain port 16 and the interior diverter bottom 44 is seated on the drain port horizontal bottom 26. The interior diverter downwardly extending flanges 53 engage the side wall interior 17. The interior diverter holding tabs 55 are attached to the side wall interior 17 above the drain port. Water from the drywell interior 14 enters the interior diverter top 43, through the diverter interior 46, out through the diverter front 41, through the drywell drain port 16, laterally dispersing into the surrounding soil, beginning at the top of the drywell. The interior diverter rear 42 and sides 45 prevent backfill soil from intruding into the drywell interior 14.

The collector assembly 30 is comprised in part of a generally rectangular box 31 with an open top 32, a bottom 33, and rectangular side walls 34. The box bottom 33 has a downwardly extending open pipe 35 adapted to fit into the drywell top port 15. The collector assembly 30 is further comprised of a perforated box cover 36.

In operation, the invention drywell 10 is inserted into an open pit formed in the ground 1. The drywell 10 is positioned within the pit so that the collector assembly cover 36 is even or slightly below the surface ground level 2. Back fill 3 is placed about the drywell to physically prevent drywell movement within the ground 1. Outflow 4 from the drywell 10 forms a drainage plume 5 about the drywell. Over time the plume outflow dries, evaporates and/or is absorbed by the ground. The use of the diverters 22 and 40 causes the outflow to push out laterally, thereby increasing the size of the plume for a given drywell size. The diverters 22, 40 also prevent backfill soil from entering into the drywell interior 14.

It is understood that the above-described embodiment is merely illustrative of the application. Other embodiments may be readily devised by those skilled in the art, which will embody the principles of the invention and fall within the spirit and scope thereof.

I claim:

1. A drywell apparatus for collecting and diverting runoff surface water or waste water, and controlling the flow and direction of subsurface water, comprising:

a top having a large diameter, central, top port, opening into a drywell apparatus interior, said top port adapted to receive surface water;

an open bottom;

a cylindrical sidewall interconnecting the drywell top and bottom, said drywell top, bottom and sidewall defining the drywell apparatus interior, said sidewall having an exterior surface and an interior surface, said sidewall having a plurality of rectangular drain-type ports distributed about the sidewall;

a plurality of interior diverters attached to the sidewall interior, within the drywell interior, each interior diverter positioned about one of the plurality of drain-type ports, each interior diverter having a front, rear, open top, bottom, and two opposite, identical sides, said interior diverter front, rear, top, bottom and sides defining a hollow interior diverter interior, wherein the interior diverter rear is divided into two sections, a top section and a lower section, wherein said interior diverter rear top section is flat and extends vertically downward to a horizontal line, wherein the interior diverter rear lower section extends downward from the horizontal line and forward to a beginning of the interior diverter bottom, wherein a plurality of downwardly extending flanges are formed at a junction of the interior diverter rear lower section and the interior diverter bottom, wherein the interior diverter front has a plurality of holding tabs adjacent the interior diverter top and extending from the interior diverter sides toward each other, wherein the remainder of the interior diverter front is open;

wherein the interior diverter front engages one of the plurality of drain-type ports and the interior diverter bottom is seated on a drain-type port horizontal bottom, wherein the interior diverter downwardly extending flanges engage the side wall interior beneath one of the plurality of drain-type ports, wherein the interior diverter holding tabs are attached to the side wall interior above a one of the plurality of drain-type ports;

wherein water from the drywell apparatus interior enters the interior diverter top through the diverter interior, out through the diverter front, through one of the plurality of drywell drain-type ports, laterally dispersing into the surrounding soil, beginning at the top of a drywell, said interior diverter rear and sides preventing backfill soil from intruding into a drywell interior.

2. A drywell apparatus as recited in claim 1, further comprising:

a collector assembly attached to said top port, said collector assembly comprised in part of a box with an open top, a bottom, and side walls, said box bottom having a downwardly extending open pipe adapted to fit into the drywell top port, said collector assembly having a perforated box cover.

3. A drywell apparatus as recited in claim 2, further comprising:

a plurality of larger diameter inlet/outlet ports to provide interconnection between and ganging of adjacent drywells.

4. A drywell apparatus as recited in claim 3, further comprising:

a removable bottom cover.

* * * * *